US006752393B2

(12) United States Patent
DiGirolamo et al.

(10) Patent No.: US 6,752,393 B2
(45) Date of Patent: Jun. 22, 2004

(54) EDUCATIONAL-GAME-OF-CHANCE-AND-TRIVIA

(76) Inventors: Severino DiGirolamo, 1707 65 Street North East, Calgary Alberta (CA), T1Y 1N5; Cody James Shaw, 1029 Radford Road North East, Calgary Alberta (CA), T2E 5G6; Jolen Gerhard DiGirolamo, 1707 65 Street North East, Calgary Alberta (CA), T1Y 1N5

( * ) Notice: Subject to any disclaimer, the term of this patent is extended or adjusted under 35 U.S.C. 154(b) by 0 days.

(21) Appl. No.: 10/065,696

(22) Filed: Nov. 11, 2002

(65) Prior Publication Data

US 2003/0111794 A1 Jun. 19, 2003

(30) Foreign Application Priority Data

Nov. 13, 2001 (CA) ..... 2,363,214

(51) Int. Cl.[7] ..... A63F 3/00
(52) U.S. Cl. ..... 273/268; 273/430
(58) Field of Search ..... 273/268, 243, 273/139, 429, 430, 431, 146

(56) References Cited

U.S. PATENT DOCUMENTS 2,253,605 A * 8/1941 Bloom ..... 273/268
4,421,315 A * 12/1983 Cutler ..... 273/268
5,288,075 A * 2/1994 Kelley ..... 273/243
5,679,002 A * 10/1997 Scelzo ..... 434/196
5,746,431 A * 5/1998 McIntyre et al. ..... 273/247

* cited by examiner

*Primary Examiner*—William M. Pierce

(57) ABSTRACT

A game board for playing a game of chance and trivia, which include; at least one set of valued question/answer cards and at least one consecutive series of blocks and integers, with each of the individual blocks being separately individually pivotally mounted on a horizontal shaft to conceal or display an integer, and at least one die. The object of the game is to achieve the highest/lowest score by; tossing at least one die and conceal or display one or more integers which; add up to the value of the die or dice. Player continues playing until the number(s) remaining in the series do not add up to the total rolled by die or dice, whereupon; the player collects a question/answer card from the corresponding categories that match the remaining displayed integer(s) from the series. Player to left of player reads the question/answer card to player, if answered correctly the player keeps card. Player continues answering questions until all the questions that correspond to the series have been challenged, whereupon; play passes to the next player. The cards remaining in the player's possession are added up to arrive at a score for that player. The player with the highest/lowest score wins the game. The game may be played using any practical number, block and card series and any type of regular polyhedral die or dice, i.e. tetrahedron, cube, octahedron, dodecahedron, icosahedra. A means of playing the present game is also disclosed.

58 Claims, 7 Drawing Sheets

EDUCATIONAL-GAME-OF-CHANCE-AND-TRIVIA

RELATED APPLICATION INFORMATION

This application claims the benefit of priority of application Ser. No. 2,363,214, filed in Canada on Nov. 13, 2001.

BACKGROUND OF INVENTION

1. Field of the Invention

This invention relates to games of high/low score chance and trivia games in general, and more specifically to a high/low score trivia game upon which may be played by two or more players. It is begun with a prearranged score, at least one set of valued question/answer cards; with the cards in each set having different subject matter from each other card and at least one consecutive series of blocks; which are separately individually pivotally from each other, and at least one consecutive series of integers. The object of the game is to achieve the lowest or highest score; by tossing at least one die and display or conceal one or more integers which add up to the total value of the die or dice, and to correctly answer the question which corresponds to the displayed integer(s) remaining in the series. Each round of play ends when a player can no longer conceal or display at least one integer from those remaining in the series; whereupon the player challenges the question corresponding to the remaining displayed integer(s). Scores are determined; by adding the value of the player's cards in his/her possession; with the player who achieves the highest or lowest score determines the winner of the game.

2. Description of the Related Art

Many different age groups have enjoyed games of trivia for many years. Trivia games and its uses are well recognized in the prior art. More specifically, trivia games that have been devised and utilized over the years are known to consist of familiar, expected, and obvious structural configurations despite the countless designs encompassed by the crowded prior art, which have been developed for the fulfillment of countless objectives and requirements. Advancing a player's token from a start position to a finish position while answering questions along a path according to the roll of a players die almost universally plays such games. Scoring consist of having the first player to whom successfully advances their marker(s) to finish position be declared winner of the game.

Advancing a player's marker according to the numeric value of the die or dice almost usually scores these types of games. Very few, if any, trivia games have been developed over the years which use the die method to conceal or display an integer(s) from at least one prearranged consecutive series of integers, and use the remaining displayed integer(s) to determine from which category(s) to challenge, and correctly answer the question corresponding to the displayed integer(s) to achieve a score for that player. Any related art forms known to the present inventor are listed below.

valued question/answer cards, and at least one die. The object of the game is to achieve the lowest or highest score depending on method of play; by tossing at least one die, and display or conceal one or more integers which add up to the total value of the die or dice, and to correctly answer the question which corresponds to the displayed integer(s) remaining in the series. Each player continues his/her turn; by tossing at least one die until that player can no longer achieve any additive numerical matches with any integer or combination of integers in the series, whereupon the player receives at least one valued question/answer card from the category set that corresponds to the displayed integer(s) in the series, and challenges the question to achieve a score by having a contiguous player to left of player read question with answers to player or player covers answer and reads question to him/her self. If player answers question correctly, player then keeps card. If player incorrectly answers question, player then forfeits card back to corresponding category and continues answering other available question/answer card(s). If player conceals or displays all the integers in the series, player then challenges all the questions corresponding to the series, and if answered correctly the player shall receive a valued card for each integer, therefore achieving the most points. Play then passes to next player who begins with either completely concealed or displayed integers, and continues playing the same game as previous player. A timer maybe used to determine the winner as the player with the highest/lowest score when the time limit has expired winning the game.

Different integers, valued question/answer card categories and types of die may be used in the present game, from at least one tetrahedron die having four faces (suitable for an integer series and card categories ranging from one through four) to and including at least one icosahedrons having twenty faces (suitable for an integer series and card categories from one through twenty) or any other regular polyhedron shape die may be used as desired, with the block series, integer series and card category's adjusted accordingly to provide a reasonable challenge.

The present dice game also includes different embodiments of a playing apparatus, comprising a game board with at least one consecutive series of pivotally mounted blocks and integers; which may be re-positioned along one edge of game board and at least one set of valued question/answer cards. The integers, blocks, and cards maybe actuated by means of mechanical, electrical, electronic, or other suitable means available.

The integers maybe either concealed or displayed in the course of play until no further play maybe accomplished according to the rules of the game. The remaining displayed integer(s) determine from which category the valued question/answer card(s) maybe challenged from, and if answered correctly will provide player with a score.

Accordingly, it is a principal object of the present invention to provide a dice game. The dice game comprising of at least one consecutive series of blocks, integers, at least one U.S. Pat. No. 5,746,431 U.S. Pat. No. 5,679,002 U.S. Pat. No. 5,288,075 A U.S. Pat. No. 4,421,315 U.S. Pat. No. 2,253,605

SUMMARY OF INVENTION

The present dice game includes at least one consecutive series of integers, example one through twelve and at least one consecutive series of blocks, and at least one set of set of valued question/answer cards and at least one die; with the die being used as a random number generator for concealing or displaying at least one integer from the series until no further play is possible.

It is another object of the present invention to provide a game apparatus for such a game. The apparatus comprising a game board with a die or dice tossing surface and at least one consecutive series of pivotally mounted blocks with integers; that maybe repositioned along one edge of game board, with the integers being selectively concealed or displayed according to the play of the game and at least one set of valued question/answer cards.

A further object of the present invention is to provide a dice game in which one or more die may be used, with the die being tetrahedron, cubical, octahedron, dodecahedron or icosahedrons as desired, with the blocks, integers and card sets adjusted accordingly to provide a reasonable challenge.

Yet another object of the present invention is to provide a dice game in which at least one level of play maybe accomplished until a single player remains who has achieved all levels of play with a predetermined minimum/maximum score.

And still another object of the present invention is to provide a dice game in which a predetermined time limit maybe set, with the winner being the player having the highest/lowest score or a predetermined minimum/maximum score before the time limit has expired.

In addition, another object of the present invention is to provide a game board, which may be played by two or more players simultaneously.

In addition, another object of the present invention is to provide a game that may also be adapted for low vision, visually impaired or blind players by means of Braille indicia, which may educate the sighted players to recognize Braille indicia while playing the game. Therefore, the sighted players maybe challenged to play the game blindfolded with a blind player.

It is therefore an object of the present invention to provide a new dice game which is of durable, dependable and of reliable construction that may be manufactured from wood, plastic or any other suitable material available.

As such, the general purpose of the present invention, which shall be described subsequently in detail, is to provide a new educational game that has all the advantages of the prior art and none of the disadvantages.

These together with other objects of the invention, along with the various features of novelty that characterize the invention described, with particularity in the claims annexed to and forming a part of this disclosure.

For a better understanding of the invention, its operating advantages and the specific objects attained by its uses, references shall be made to the accompanying drawings and descriptive matter in which there are illustrated preferred embodiments of the invention.

DETAILED DESCRIPTION

The present invention comprises a means of playing an educational dice game, wherein at least one die may be used to generate a random integer which corresponds with at least one prearranged consecutive series of integers, and at least one set of valued question/answer cards provided with the game. The object of the game is to achieve (depending on method of play selected) the lowest or highest score; by tossing at least one die and conceal or display one or more integers in the series which add up to the total value of the die or dice. Player tosses the die or dice until no further concealing or displaying of integers is permissible and then correctly challenges the question, which corresponds to each of the displayed integer(s) remaining in the series. Each player continues his/her turn by; tossing at least one die until that player can no longer achieve any additive numerical match(s) with any integer or combination of integers in the series.

The player then receives a valued question/answer card from the set that corresponds to the displayed integer(s) in the series and challenges the question to achieve a score; by having a contiguous player to left of player read question with answers to player or player covers answer and reads question with answers to him/her self. If player answers question correctly player then keeps card. If player answers question incorrectly, player then forfeits card back to corresponding set, and continues answering other available question/answer card(s). If player conceals or displays all integers in the series, player then challenges all the questions corresponding to the series, and if answered correctly player receives a valued card for each integer, therefore achieving the most points. Play then passes to next player who begins with either completely concealed or displayed integers and continues playing the same game and method as previous player. A timer maybe used to determine the winner and duration of play, with the player achieving the highest/lowest score, or a predetermined minimum/maximum score before the time limit has expired.

Figure 1B:
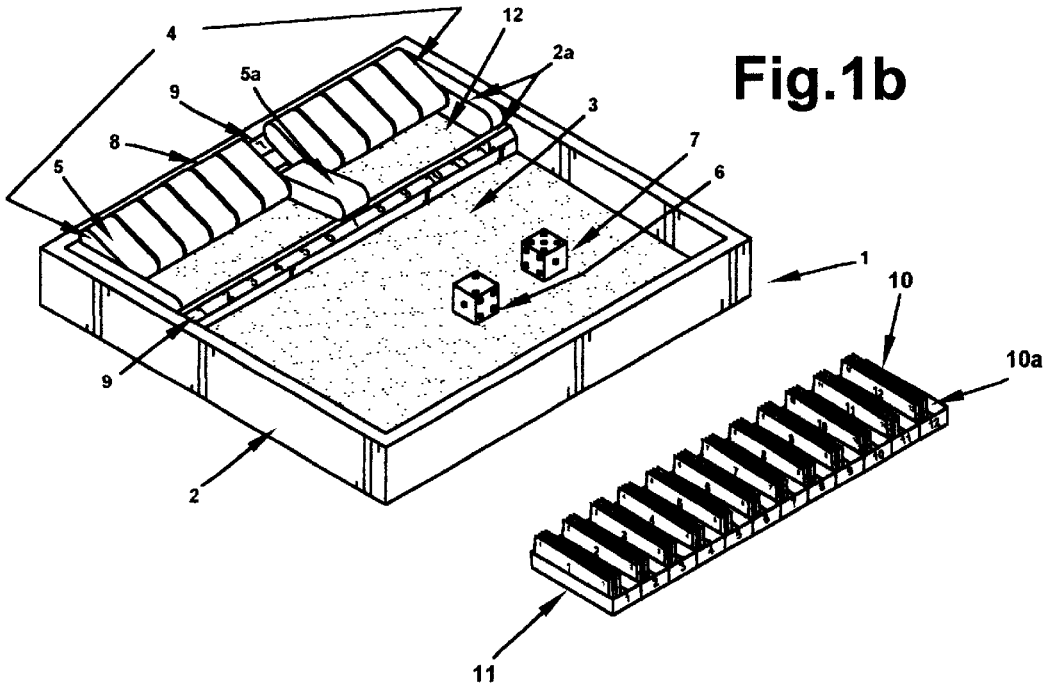
FIG. 1*b*: is a perspective view of a first embodiment of a board game showing its various features, with the card sets and holder removed from game board and positioned along peripheral wall of game board, with one block displaying one integer and a pair of dice removed from the storage compartment and tossed upon playing surface.

FIG. 1*b* provides a perspective view of a first embodiment of a game board (1); which maybe used for play in the present game. The board (1) includes a peripheral wall (2) surrounding a surface (3) for tossing a die or dice thereupon. (Example cubical dice (6) and (7) to generate random integers.) The board (1) also includes a peripheral wall (2*a*) surrounding at least one storage compartment (12) (for storing dice, writing utensils, etc.) and also surrounding at least one consecutive series of blocks (4) and integers (9), example one through twelve also shown in FIGS. 1*c*, 3, 3*a*, 3*b*, 5 and 8, with each of the blocks (4) being individually selectively positional between a displayed position and a concealed position which may be re-positioned along a peripheral wall (2) of game board (1) as shown in FIG. 8.

Each of the blocks (4) are mounted on a horizontal shaft (not shown) and positioned selectively, independently, pivotally from each other between a concealed position (5) and a displayed position (5*a*) and are used for concealing or displaying an integer as shown by reference number 5 and 5*a* in FIG. 1*b*.

Figure 3:
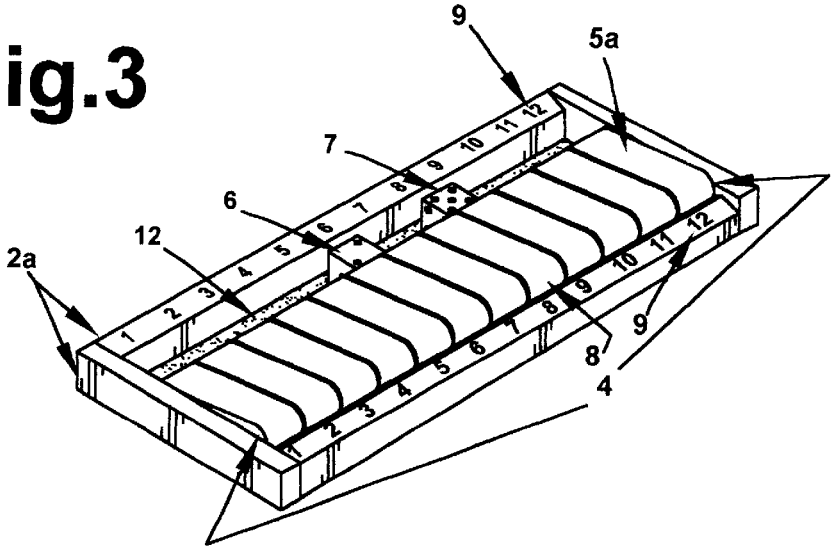
FIG. 3: is a perspective view of a plurality of peripheral walls surrounding at least one consecutive series of blocks, and pair of die in the storage compartment, and two consecutive series of integers positioned on two peripheral walls, which; maybe re-positioned along a peripheral wall of game board and used for play in the present board game.
Figure 3A:
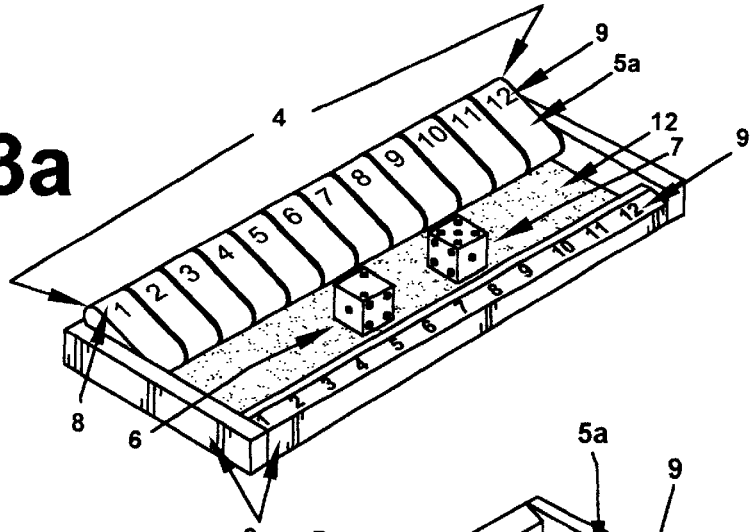
FIG. 3*a*: is a perspective view of a plurality of peripheral walls surrounding at least one consecutive series of blocks with integers positioned on at least one face of said blocks and pair of die in the storage compartment and integers positioned on a peripheral wall, which; maybe re-positioned along a peripheral wall of game board and used for play in the present board game.
Figure 3B:
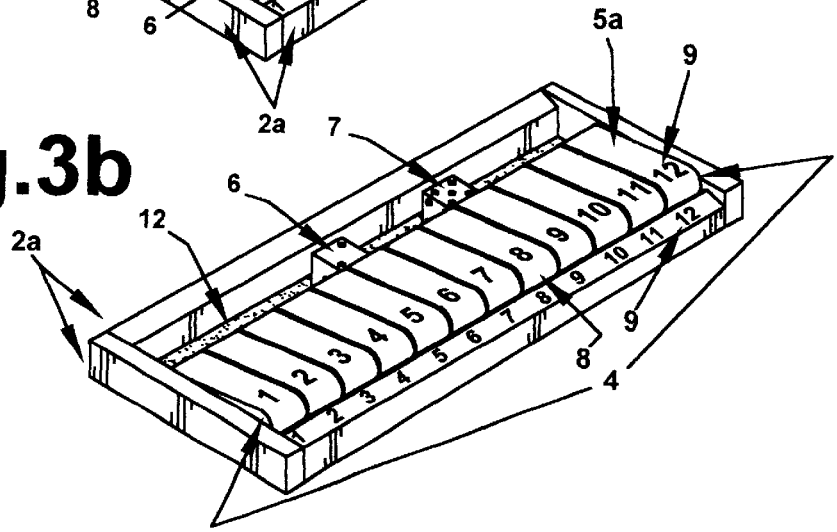
FIG. 3*b*: is a perspective view of a plurality of peripheral walls surrounding at least one consecutive series of blocks with integers positioned on at least one face of said blocks and pair of die in the storage compartment and integers positioned on a peripheral wall, which; maybe re-positioned along a peripheral wall of game board and used for play in the present board game.
Figure 8:
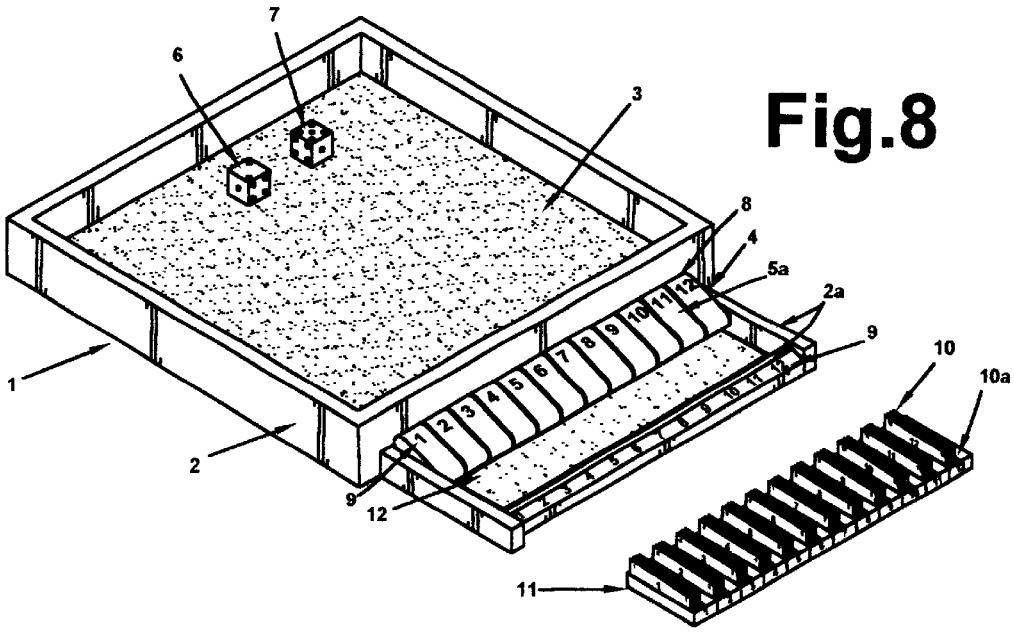
FIG. 8: is a perspective view of a board game and its various features showing a plurality of peripheral walls surrounding a playing surface with a pair of dice tossed thereon, and plurality of peripheral walls surrounding the block and integer series and storage compartment, with integers on at least one face of said blocks, and integers on one of the peripheral walls surrounding the block series and storage compartment, with the card sets and holder, integer series, block series removed from game board and re-positioned along a peripheral walls of game board.

The integers (9) maybe positioned on a peripheral wall (2*a*) as shown in FIGS. 1*c*, 3, 3*a*, 3*b*, and 5 or on at least one face of said blocks (4) also shown in FIG. 3*a* and 3*b* and 8. Each of the blocks (4) may include a chamfered lip or edge (8) on at least one face of said blocks (4) as shown in FIGS. 1*c*, 3, 3*a*, 3*b*, 5, 7 and 8. The board game further includes at least one cardholder (11), a plurality of card sets (10*a*), and a plurality of cards (10) which; maybe re-positioned along a peripheral wall (2) of game board (1).

The present game maybe played by selecting a means and order of play between two or more players. Each player tosses the die or dice two or more times until no further moves for concealing or displaying integers are possible, whereupon player challenges to correctly answer the question of the valued question/answer card(s) (10) in the at least one card set (10*a*) that corresponds with the displayed integer(s) in the series (9). If answered correctly player keeps valued card(s) (10). If answered incorrectly player forfeits card (10) to designated card set (10*a*) and play passes to the next player who plays the same game and method as the previous player.

Play is accomplished by tossing at least one die (6) and conceal or display at least one integer (9) that corresponds to the additive value of the die or dice (6) and (7). Player continues his/her turn concealing or displaying integers until no further play is possible, whereupon player collects or forfeits a valued question/answer card (10) that corresponds to the remaining displayed integers in the series (9). The object of the game is to selectively conceal (5) or display (5*a*) as many integers (9) as possible and be challenged to collect or forfeit as many correctly answered cards (10) from the card set (10*a*) as possible to achieve the highest/lowest score. When player can no longer additively correspond the integer (9) or combinations of integers, with any additive value of the die or dice (6) and (7), player then challenges to answer (10*c*) the question (10*b*) of the card(s) (10) from the at least one card set (10*a*) that corresponds with the displayed integer(s) in the series (9). If answered (10*c*) correctly player keeps valued card(s) (10). If answered (10*c*) incorrectly player forfeits card (10) to the bottom of the designated card set (10*a*). Player continues playing out his/her turn until no further questions remaining, whereupon that player's turn is over and the play passes to the next predetermined player in order of play.

It shall also be known, that if more than six integers are used in the course of play, i.e. (one through twelve using a pair of cube die) if any integer(s) greater than six are still displayed or concealed (depending on method of play selected), the player must use the pair of cube die until any integer(s) that are greater than six are either fully displayed or concealed. If integer(s) in the series are less than seven integers, then the player would then have the option of using one die with the other remaining die placed in the storage compartment and continues play.

As an example of the above as shown in FIG. 1*b*, let us assume that the method of play agreed amongst players is to achieve the highest score to win the game. The game board is set up with all the integers (9) in the series concealed (5). The first player tosses die (6) and (7) to arrive at a random number, i.e. five and two for a total value of seven.

The player may choose to display (5*a*) any integer (9) or combination of integers in the series, which additively correspond to the value of the dice. In the example shown in FIG. 1*b* the player has chosen to display (5*a*) integer 7 (shown as reference number 9) and leaving the remaining integers 1,2,3,4,5,6,8,9,10,11,12 concealed (5). The rules allow any integer (9) or combination of integers, which additive value(s) correspond with the die or dice, to display (5*a*) the integer(s) (9) in the series. However, the player may have chosen to display the integer six and one or five and two etc.

As the play continues, the player tosses the die (6) and (7), and displays (5*a*) any integer (9) or combination of integers that correspond with the additive value of the die (6) and (7). When the player can no longer display (5*a*) any integer(s) from the series (9), player then challenges a valued question/answer card(s) (10) from the set(s) (10*a*) that correspond with the displayed (5*a*) integer(s) (9) in the series. Player contiguous to left of player reads player question with answers or player covers answer and reads question with answers to him/her self. If correctly answered, player keeps valued card (10). If incorrectly answered, the player forfeits card (10) to the bottom of designated set (10*a*). When player has challenged all corresponding cards (10) of the card sets (10*a*), player's turn is over and the game board passes on to the next player who continues playing the game with the same method and order of play as the previous player.

If player displays (5*a*) all the integers (9) in the series, then that player challenges all valued question/answer cards (10) from each set (10*a*) to achieve the highest score, whereupon; the game board passes on to the next player who continues playing the game with the same method and order of play as the previous player. Players add the value of the cards (10) in his/her possession to achieve a score for that player. Player achieving the highest score determines winner.

Figure 1C:
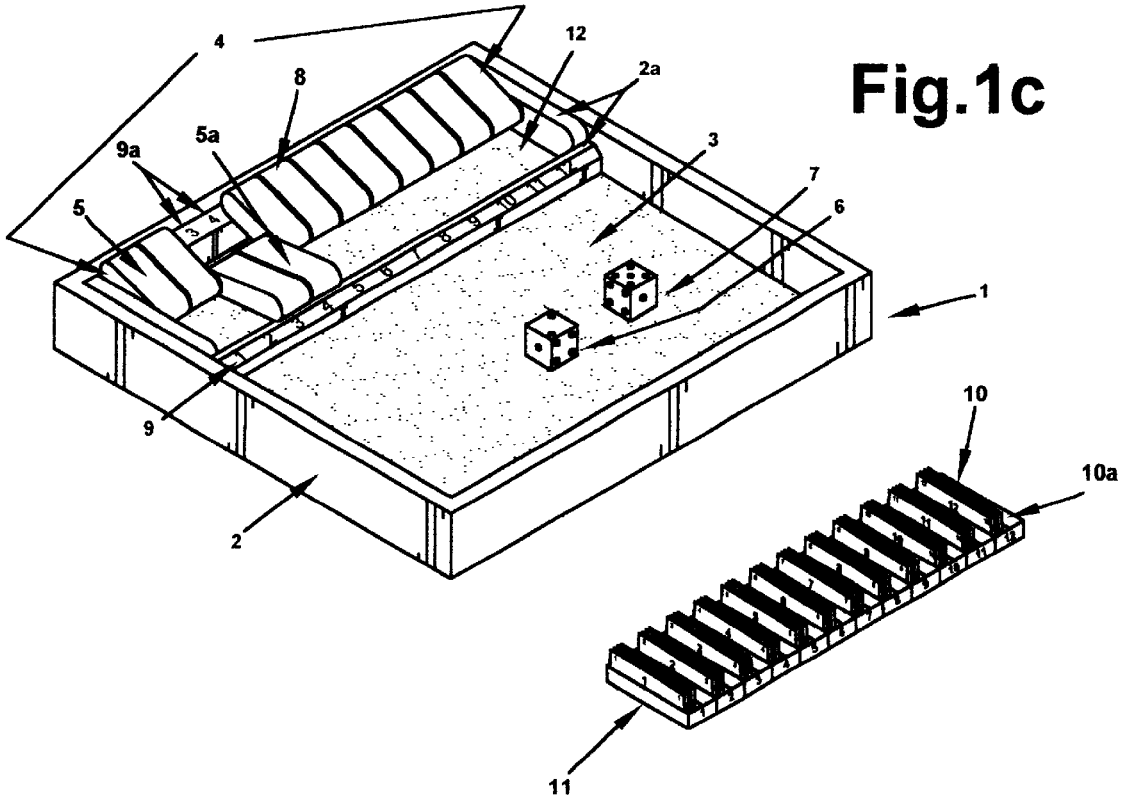
FIG. 1*c*: is a perspective view of a first embodiment of a board game showing its various features, with the card sets and holder removed from game board and positioned along peripheral wall of game board, with two blocks displaying two integers and a pair of dice removed from the storage compartment and tossed upon playing surface.
Figure 1D:
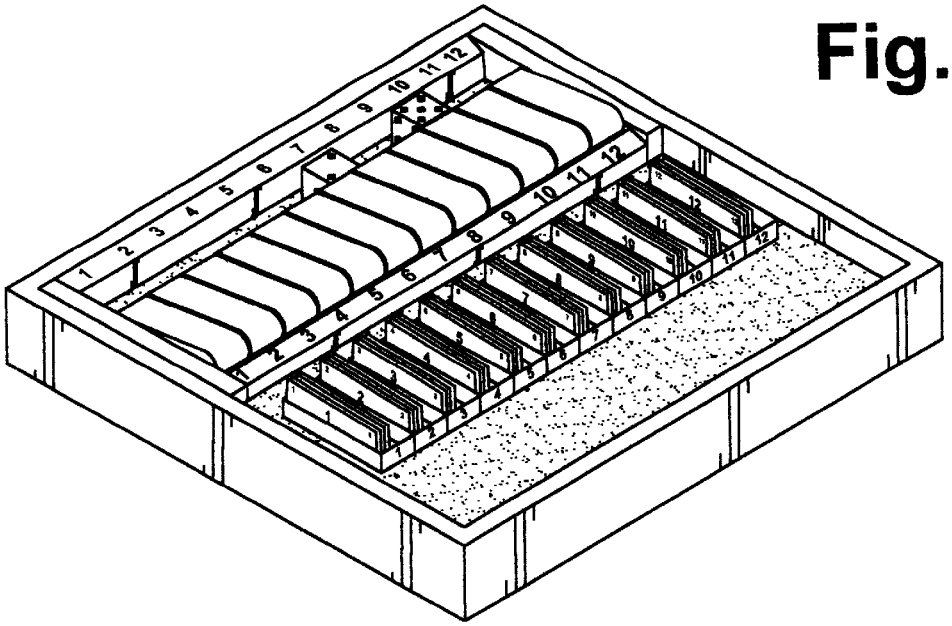
FIG. 1*d*: is a perspective view of a first embodiment of a board game showing its various features with at least one consecutive series of integers displayed, with a pair of dice in the storage compartment and the card set and holder positioned on the playing surface.
Figure 1E:
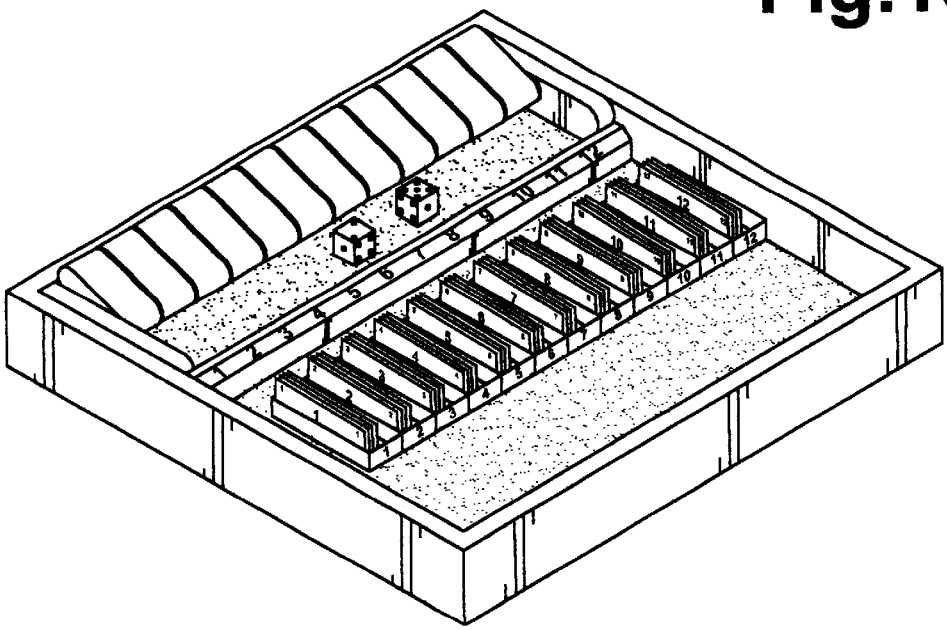
FIG. 1*e*: is a perspective view of a first embodiment of a board game showing its various features with at least one consecutive series of integers concealed, with a pair of dice in the storage compartment and the card set and holder positioned on the playing surface.

As another example of the above as shown in FIG. 1*c*, let us assume that the method of play agreed amongst players is to achieve the lowest score to win the game. All players receive a valued question/answer card (10) from each set (10*a*). The game board is set up with all integers (9) in the series concealed (5). The first player tosses die (6) and (7) to arrive at a random number, i.e. five and two for a total value of seven. The player may choose to display (5*a*) any integer (9) or combination of integers in the series, which additively correspond to the value of the die or dice.

In the example shown in FIG. 1*c*, the player has chosen to display (5*a*) integers 3 and 4, (shown as reference number 9*a*) and leaving the remaining integers 1,2,5,6,7,8,9,10,11, 12 concealed (5).

The rules allow any integer (9) or combination of integers, which additive value(s) correspond with the die or dice to display (5*a*) the integer(s) (9) from the series. However, the player may have chosen to display the integer six and one or five and two etc.

As the play continues, the player tosses the die (6) and (7), and displays (5*a*) any integer (9) or combination of integers that correspond with the additive value of the die (6) and (7). When the player can no longer display (5*a*) any integer(s) (9) from the series, player then challenges a valued question/answer card(s) (10) in his/her possession that correspond with the displayed (5*a*) integer(s) (9) in the series. Player contiguous to left of player reads player question with answers or player covers answer and reads question with answers to him/her self. If correctly answered, player forfeits valued card (10) to the bottom of designated set. If incorrectly answered, the player keeps card (10). When player has challenged all corresponding set(s) (10*a*), player's turn is over and the game board passes on to the next player who continues playing the game with the same method and order of play as the previous player. If player displays (5*a*) all the integers (9) in the series, then that player challenges all valued question/answer cards (10) in his/her possession to achieve the lowest score, whereupon; the game board passes on to the next player who continues playing the game with the same method and order of play as the previous player. Players add the value of the cards (10) in his/her possession to achieve a score for that player. Player achieving the lowest score determines winner.

It shall be acknowledged; that it is possible for a player to produce a random integer with the die (6) and (7), which allow a player to display (5*a*) or conceal (5) all the integers in the series, and therefore; challenging a valued question/answer card (10) from each set (10*a*) to achieve the maximum/minimum score. These are the best scores and are the object of each player of the game to achieve.

Although it has been mentioned above, that a "die or dice" may be used in play in the present game. It should also be noted that the integer series, block series, and the card sets must be adjusted accordingly so that the highest card set, blocks and integer series, is no higher than the highest integer shown on die or dice, or a plurality of dice.

In the present disclosure, the term "die or dice" respectively refers to at least one regular polyhedron die, each having a plurality of equally sized and shaped faces upon which a series of continuous numbers are placed and being equivalent to the number of faces of the polyhedron. The polyhedrons may be tetrahedron having four sides, or a cube having six sides, as in dice (6) and (7) of FIG. 1, or an octahedron having eight sides, or dodecahedron having twelve sides, or icosahedrons having twenty sides. Any of the above described configurations, either single or plural, maybe used for plays in the present game.

Figure 4:
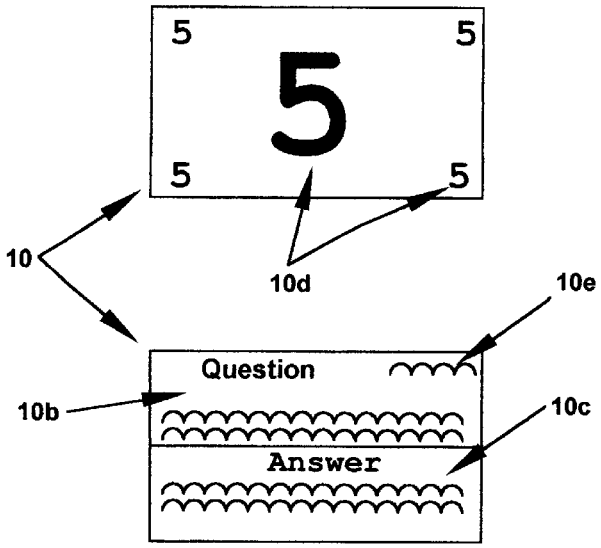
FIG. 4: is a perspective view of a valued question/answer card with indicia, and a numbered card set holder, with at least one card set in said holder, which may be re-positioned along a peripheral wall of game board and maybe used for play in the present board game.
Figure 7:
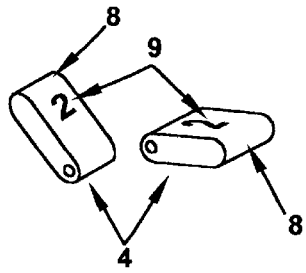
FIG. 7: is a perspective view of a block having six faces, with and integer on at least one face of said faces, and at least one chamfered edge, which; maybe used for play in the present board game.
Figure 7:
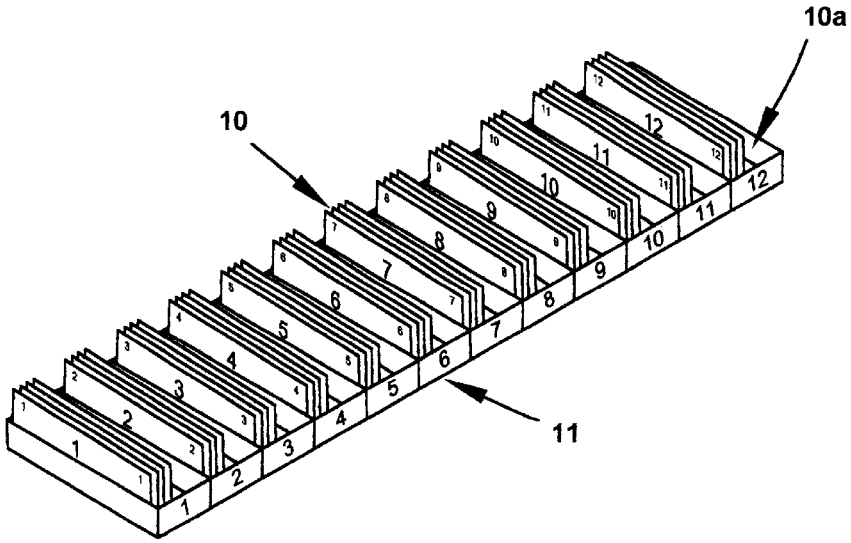
Figure 5:
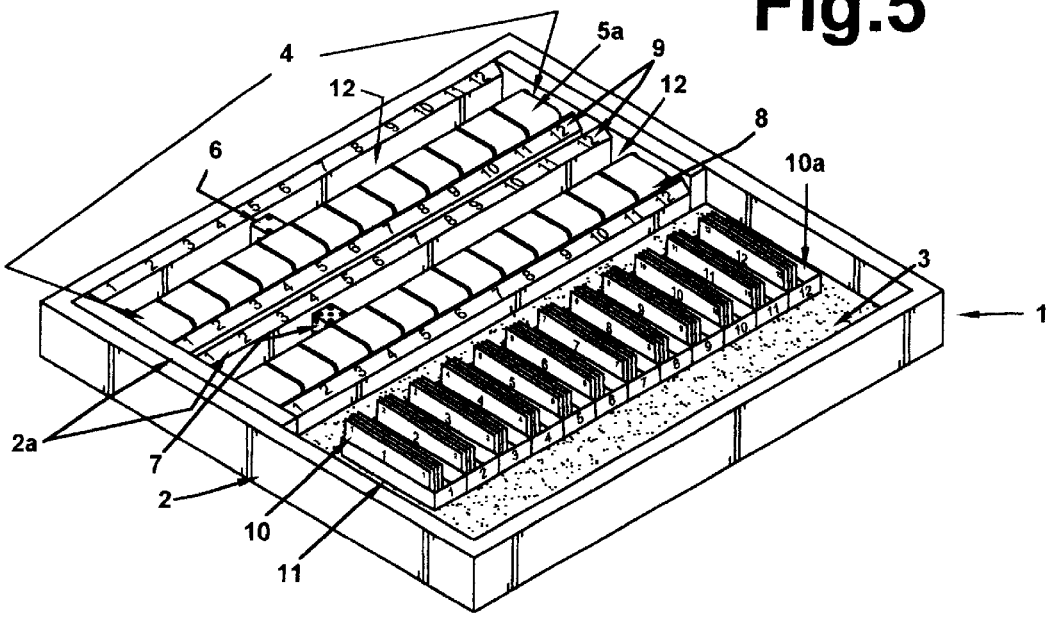
FIG. 5: is a perspective view of a board game for two simultaneous players and its various features showing a plurality of peripheral walls with four consecutive series of integers positioned on four of the peripheral walls surrounding at least one consecutive series of blocks, and at least one storage compartment with a die therein, and a playing surface with card sets and holder thereon.

In the present disclosure, the term "card or cards" respectively refers to a card (10) with two faces; with each face having written indicia, numerical indicia and symbols thereon; with one face of said card (10) having a numeric value (10*e*), written indicia, numeric indicia and symbols (10*b* 10*c* and 10*d*), as shown in FIG. 4. The question and answer cards (10) may also comprise a plurality of different categories (10*a*).

The invention is not limited to any plurality of valued question/answer cards a set. Plurality may include a set of valued question/answer cards (10), each set includes valued question/answer cards related to themes, topics, politics, music, sports, religion, history, current affairs, drama, education, profession, trades etc. Subject matter or theme of the board game may vary, and may comprise of many categories (10*a*) of subject matter.

Figure 2:
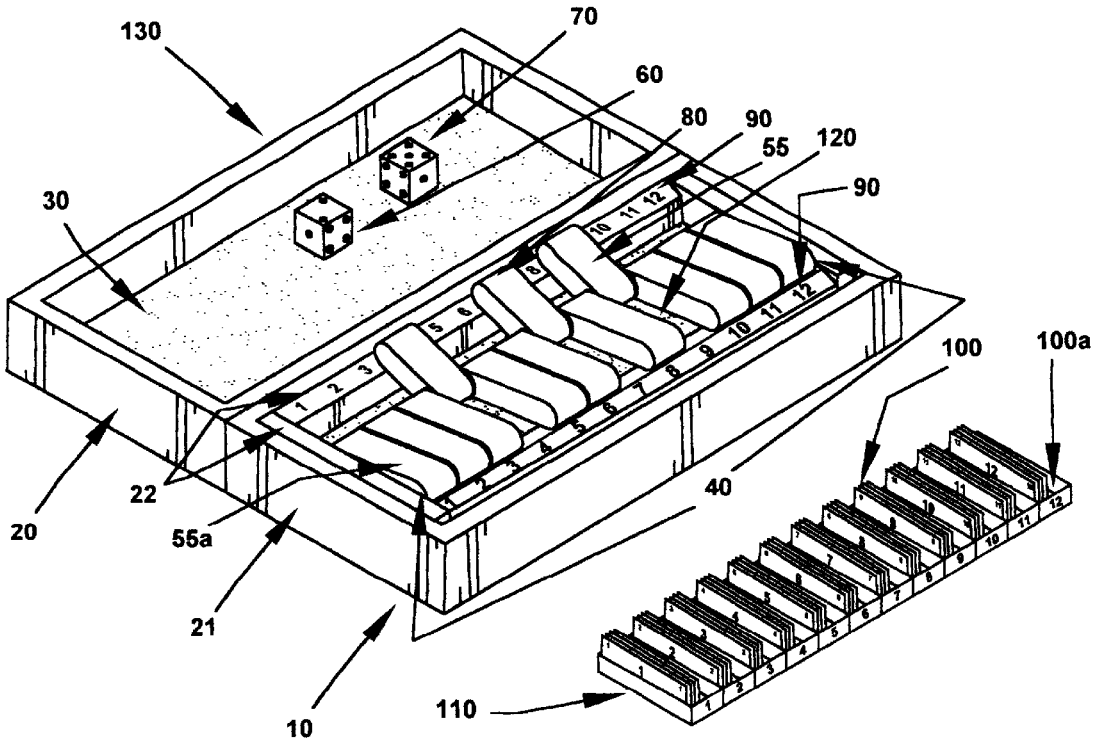
FIG. 2: is a perspective view of a second embodiment of the present board game showing its various features, with the card sets and holder removed and positioned along peripheral wall of game board, and at least one consecutive series of blocks concealing three integers, and a pair of dice removed from the storage compartment and tossed upon the cover/playing surface, which; is secured pivotally to one of the peripheral walls of game board.

FIG. 2 provides a perspective view of second embodiment of a game board designated as game board (10). This is similar to the characteristics of game board (1) of FIG. 1*b*. In addition to the structure of the game board (10), the game board (10) also includes a plurality of peripheral walls (21) and (22) surrounding at least one consecutive series of blocks (40), and at least one consecutive series of integers (90), and a storage compartment (120). It also includes a plurality of peripheral walls (20) surrounding a playing surface (30) which is also used as a cover (130) and for tossing at least one die thereon, example cube dice (60) and (70), which; is secured pivotally to a peripheral wall (21) of game board. (10) The cover (130) is also used to maintain block (40) and integer (90) position when positioned over said game board (10).

Each of the blocks (40) of the game board (10) are positioned pivotally, independently, separately and are individually selected on a horizontal shaft to display or conceal an integer in the manner similar to the configuration shown in FIG. 1*b*. The board game also includes at least one cardholder (110) and a plurality of card sets (110*a*) with a plurality of cards (100); which maybe repositioned along a peripheral wall (20) or (21) of game board (10).

Figure 6:
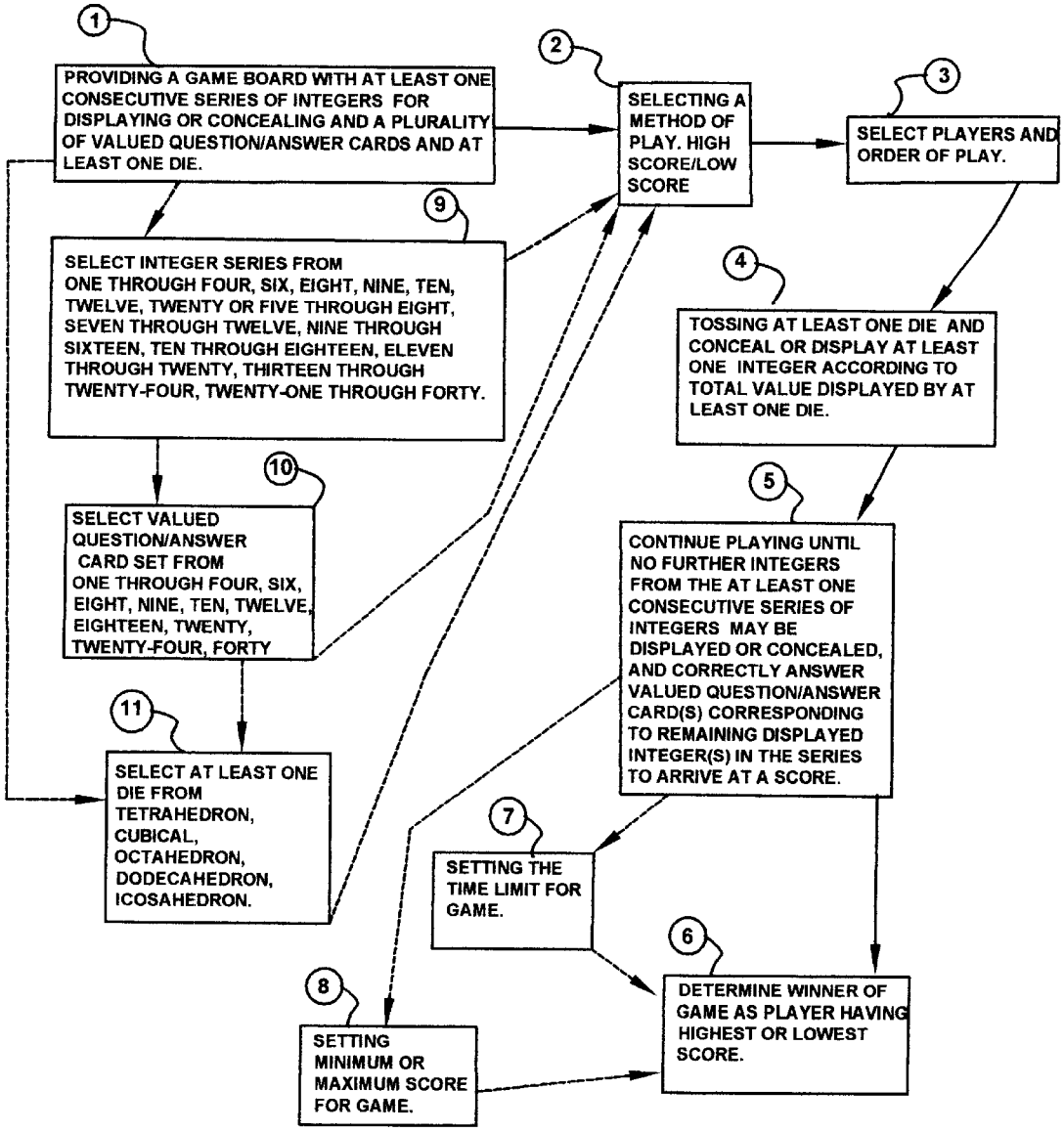
FIG. 6: is a flow chart showing its various steps and at least one method of playing the present dice game.

A means of playing the present dice game is shown in the flow chart in FIG. 6. The game board may be set up to be viewed by all players by having the integers displayed or concealed as in game board (1) of FIGS. 1*d* and 1*e*, with the appropriate die or dice selected as in the first step (1) of FIG. 6. Depending on the degree of difficulty of the game and the die or dice selected, the series may comprise of at least one consecutive series of integers. The integers may comprise of one through four, six, eight, nine, ten, twelve, and twenty.

The series may also include the integers five through eight, seven through twelve, ten through eighteen, eleven through twenty, thirteen through twenty four, twenty-one through forty or some other series as desired. Also, a corresponding valued question/answer card set ranging from one through four, six, eight, nine, ten, twelve, eighteen, twenty, twenty-four, forty, and a corresponding die or dice being selected from four, six, eight, twelve or twenty sided, in accordance with the optional second, third, and forth step, respectively 9, 10, and 11 of FIG. 6.

Once the degree of difficulty of the game has been described and agreed amongst players; the players choose a means of play as accordance to the second step of FIG. 6. Order of play is determined by tossing the die/dice amongst two or more players, and by having the highest number on die/dice for playing a high score game go first, and the lowest number on die/dice for playing a low score game go first or other means agreed upon accordance with the third step of FIG. 6. The first player tosses die or dice and displays or conceals one or more integers in the at least one consecutive series of integers that correspond to the additive value of the die or dice, in accordance to the fourth step of FIG. 6.

Play is continued in the above manner until the first player rolls a number or combination of numbers which do not additively correspond with at least one integer of the at least one consecutive series of integers in the series. At this point, the player receives a valued question/answer card(s) from the set(s) that corresponds to the remaining displayed integers in the series. If answered correctly, player keeps valued card(s). If answered incorrectly, player forfeits card to the bottom of the designated card set. Player continues playing out his/her turn until no further questions remaining, whereupon that player's turn is over. At this point, the player adds the value of the cards in his/her possession to achieve a score for that player as in accordance with the fifth step of FIG. 6. Play then passes to the next player, who returns all the integers in the series to a completely concealed or displayed position and plays in the same manner described above for the first player and in accordance with the rules described above.

After all players have completed a single round of play, the players may compare their scores, with the player having the highest or lowest score, winning the game, as in accordance with the sixth step of FIG. 6. Alternately, many levels of play may be achieved, with the players each being limited by correctly challenging the questions at each level of play to arrive at a predetermined score limit, i.e. seven hundred and eighty points or some other predetermined limit. Players may start play at any level agreed upon, i.e. 5, 6, 7 etc. Players continue playing according to the above-mentioned rules.

When player successfully challenges the questions at each level of play, the game board passes to the next player who continues playing the game as previously mentioned above. When the game board is passed onto a player who has successfully challenged the previous level, that player now challenges the next level of play and continues the game.

The first player to successfully challenge the last level of play ends the game. Players then add-up his/her points to achieve a score, with player having the highest/lowest score being the winner.

Example of 4 levels of play using six integers to conceal or display are listed below:

Level 1: Integers one through three, utilizing one cube die; players would have to achieve six on die in order to conceal or display all integers thereby, successfully challenging all the questions in order to achieve to the next level of play.

Level 2: Integers one through four utilizing one cube die; players would have to achieve ten with multiple tosses of the die in order to conceal or display all integers thereby, successfully challenging all the questions in order to achieve to the next level of play.

Level 3: Integers one through five utilizing one cube die; players would have to achieve fifteen with multiple tosses of the die in order to conceal or display all integers thereby, successfully challenging all the questions in order to achieve to the next level of play.

Level 4: Integers one through six utilizing one cube die; players would have to achieve twenty-one with multiple tosses of the die in order to conceal or display all integers thereby, successfully challenging all the questions in order to achieve to the next level of play.

The present dice game may also utilize a timer to limit the length of play, with the winner determined by the player with the maximum/minimum score when the time limit has expired winning the game, in accordance with the seventh step of FIG. 6.

In accordance to levels of difficulty as mentioned in the above examples, it shall also be known that the lowest card category being the least challenging and the highest card category being the most challenging for players, with the first player to reach and achieve maximum/minimum score ends the game in accordance with the eighth step of FIG. 6.

It shall also be known, that the present dice game may also be adaptable for the education, profession, and trade system or any field that requires training or certificate of achievement as examples given below.

Integers one through four may be adapted for pre-school educational purposes, where the subject matter pertains to a specific level of education.

Integers one through six may be adapted for elementary educational purposes, where the subject matter pertains to a specific level of education.

Integers one through nine may be adapted for junior high/middle school educational purposes, where the subject matter pertains to a specific level of education.

Integers one through twelve may be adapted for high school educational purposes, where the subject matter pertains to a specific level of education.

Integers one through twenty may be adapted for college/technical training educational purposes, where the subject matter pertains to a specific level of education.

Integers one through forty may be adapted for university educational purposes, where the subject matter pertains to a specific level of education.

It shall also be known, that the present dice game may be adapted to a study game for individuals, wherein; subject matter corresponds to a particular field of training, i.e. one through nine may be used to test the knowledge of a specific trade/profession, wherein player in that particular field may be able to achieve more knowledgeable information by; quizzing him/her self with question/answer cards pertaining to their particular field of training.

It shall be known, that the present dice game may also be adapted for play for the blind individuals; by having Braille indicia on the integer series, block series and valued question/answer cards. Thereby having a sighted, low vision, visually impaired, and/or blind players challenging each other.

In summary, the present dice game in its various embodiments provides a means of playing a game, utilizing die of various configurations. A more advanced play may utilize two or more dice of various configurations, or combinations of, with the consecutive integer series, consecutive block series and the card sets of the game are limited only by practicality, and that a particular educational and entertaining board game is provided by the present invention.

Those skilled in the art will appreciate from the above-mentioned description, that the present dice game has all the advantages of the prior art and none of the disadvantages and is extremely versatile and perhaps enjoyed by individuals of all ages and interests.

Therefore, the foregoing is considered as illustrative only of the principals of the invention. Further, since numerous modifications and changes will readily occur to those skilled in the art, it is not preferred to limit the invention to the exact construction and operation shown and described. Accordingly, all suitable modifications and equivalents may be resorted to falling within the scope of the following claims.

What is claim is:

1. A method of playing a dice game comprising the following steps:

(a) providing at least one die having a plurality of different faces with corresponding different number means disposed on each of the said faces; and (b) providing at least one consecutive series of blocks for displaying or concealing at least one integer according to random number generated by at least one die; and (c) providing at least one consecutive series of integers for concealing or displaying according to random number generated by at least one die; and (d) providing at least one consecutive series of integers for identifying category's of subject matter; and (e) providing at least one set of valued question/answer cards of subject matter; and (f) providing at least one level of play; and (g) selecting a level of play; and (h) providing at least one method of play; and (i) selecting a method of play; and (j) providing a predetermined maximum score; and (k) providing a predetermined minimum score; and (l) setting a predetermined time limit; and (m) selecting at least a first player and a second player and determining an order of play; and (n) tossing at least one die by the first player and generating random number which additively correspond to an integer(s)thereby;

(o) concealing at least one of the integers of the at least one consecutive series of integers by the first player according to the random number generated by tossing the at least one die by the first player; or (p) displaying at least one of the integers of the at least one consecutive series of integers by the first player according to the random number generated by tossing the at least one die by the first player; and (q) continuing in the above manner by the first player until arriving at a random number which does not additively correspond with any of the integers of the at least one consecutive series of integers; and (r) using the remaining displayed integers in the at least one consecutive series of integers for selecting question/answer card category; and (s) collecting the correctly answered cards and passing the game and at least one die to the second player to continue the game; or (t) forfeiting the correctly answered cards and passing the game and at least one die to the second player to continue the game; and (u) adding the value of the question/answer cards in player's possession to achieve a score for that player.

2. A method of playing a dice game according to claim 1, including the steps of:

(a) providing a game board including a plurality of peripheral walls defining a cover for retaining score, block, and integer position; and (b) providing a game board including a plurality of peripheral walls defining a surface there-between for tossing at least one die thereon; and (c) further providing a plurality of peripheral walls surrounding at least one storage compartment for storing at least one die and game utensils which; may be repositioned along a peripheral wall of said game board; and (d) further providing a plurality of peripheral walls surrounding at least one consecutive series of blocks, with each of said blocks being individually selectively positioned between a displayed position and a concealed position which; may be repositioned along a peripheral wall of said game board; and (e) further providing a plurality of peripheral walls surrounding at least one consecutive series of integers, with each of said integers being individually selectively positioned between a displayed position and a concealed position according to random number generated by at least one die which; may be repositioned along a peripheral wall of said game board; and (f) further providing at least one question/answer cardholder which; may be repositioned along a peripheral wall of said game board; and (g) further providing at least one set of valued question/answer cards which; may be repositioned along a peripheral wall of said game board; and (h) further providing at least one consecutive series of integers positioned on at least one of the peripheral walls of said peripheral walls of said blocks and integer series.

3. A method of playing a dice game according to either claim 1 or 2, of providing at least one consecutive series of blocks with each block having six faces and may include a chamfered edge or lip on at least one face of said blocks.

4. A method of playing a dice game according to either claim 1 or 2, of setting the at least one consecutive series of integers to comprise the numbers one through four.

5. A method of playing a dice game according to either claim 1 or 2, of setting the at least one consecutive series of integers for identifying category's of subject matter to comprise the number one through four.

6. A method of playing a dice game according to either claim 1 or 2, of setting the at least one consecutive series of valued question/answer cards to comprise the numbers one through four.

7. A method of playing a dice game according to either claim 1 or 2, of providing at least one set of valued question/answer cards with each set having a plurality of cards.

8. A method of playing a dice game according to either claim 1 or 2 wherein each said card having two faces with a symbol on at least one face of said faces.

9. A method of playing a dice game according to either claim 1 or 2 in which; each face of said cards having numerical and written indicia thereon.

10. A method of playing a dice game according to claim 1 of setting a prearranged maximum score far game with the first player to achieve this score wins the game.

11. A method of playing a dice game according to either claim 1 or 2 wherein each set of valued question/answer cards provide different difficulty means with the lowest valued question/answer card set having the least difficult questions to answer and the highest valued question/answer card set having the most difficult questions to answer.

12. A method of playing a dice game according to claim 1, including the step of determining an order of play by two or more players with lowest value on die determining first player in a low score game and the highest value on die determining first player in a high score game.

13. A method of playing a dice game according to claim 1, of providing at least one tetrahedron die having four sides, with each said side including a different integer from one through four.

14. A method of playing a dice game according to claim 1, of selling a predetermined time limit for the game and playing in turn until reaching the predetermined time limit, with the player having the highest score being the winner of the game.

15. A method of playing a dice game according to either claim 1 or 2, of setting the at least one consecutive series of integers to comprise the numbers one through six.

16. A method of playing a dice game according to either claim 1 or 2, of setting the at least one consecutive series of integers to comprise the numbers one through eight.

17. A method of playing a dice game according to either claim 1 or 2, of setting the at least one consecutive series of integers to comprise the numbers one through nine.

18. A method of playing a dice game according to either claim 1 or 2, of setting the at least one consecutive series of integers to comprise the numbers one through twelve.

19. A method of playing a dice game according to either claim 1 or 2, of setting the at least one consecutive series of integers to comprise the numbers one through twenty.

20. A method of playing a dice game according to either claim 1 or 2, of setting the at least one consecutive series of integers to comprise the numbers one through forty.

21. A method of playing a dice game according to either claim 1 or 2, of setting the at least one consecutive series of integers for identifying category's of subject matter to comprise the numbers one through six.

22. A method of playing a dice game according to either claim 1 or 2, of setting the at least one consecutive series of integers for identifying category's of subject matter to comprise the numbers one through eight.

23. A method of playing a dice game according to either claim 1 or 2, of setting the at least one consecutive series of integers to comprise the numbers one through nine.

24. A method of playing a dice game according to either claim 1 or 2, of setting the at least one consecutive series of integers for identifying category's of subject matter to comprise the numbers one through twelve.

25. A method of playing a dice game according to either claim 1 or 2, of selling the at least one consecutive series of integers for identifying category's of subject matter to comprise the numbers one through twenty.

26. A method of playing a dice game according to either claim 1 or 2, of selling the at least one consecutive series of integers for identifying category's of subject matter to comprise the numbers one through forty.

27. A method of playing a dice game according to either claim 1 or 2, of setting the at least one consecutive series of valued question/answer cards to comprise the numbers one through six.

28. A method of playing a dice game according to either claim 1 or 2, of setting the at least one consecutive series of valued question/answer cards to comprise the numbers one through eight.

29. A method of playing a dice game according to either claim 1 or 2, of setting the at least one consecutive series of valued question/answer cards to comprise the numbers one through nine.

30. A method of playing a dice game according to either claim 1 or 2, of setting the at least one consecutive series of valued question/answer cards to comprise the numbers one through twelve.

31. A method of playing a dice game according to either claim 1 or 2, of setting the at least one consecutive series of valued question/answer cards to comprise the numbers one through twenty.

32. A method of playing a dice game according to either claim 1 or 2, of setting the at least one consecutive series of valued question/answer cards to comprise the numbers one through forty.

33. A method of playing a dice game according to claim 1 of, setting a prearranged minimum score for game with the first player to achieve this score wins the game.

34. A method of playing a dice game according to claim 1, of providing at least one cube die having six sides, with each said side including a different integer from one through six.

35. A method of playing a dice game according to claim 1, of providing at least one octahedron die having eight sides, with each said side including a different integer from one through eight.

36. A method of playing a dice game according to claim 1, of providing at least one dodecahedron die having twelve sides, with each said side including a different integer from one through twelve.

37. A method of playing a dice game according to claim 1, of providing at least one icosahedrons die having twenty sides, with each said side including a different integer from one through twenty.

38. A method of playing a dice game according to claim 1, of setting a predetermined time limit for the game and playing in turn until reaching the predetermined time limit, with the player having the lowest score being the winner of the game.

39. A dice game comprising: a game board;

said genie board including a plurality of peripheral walls defining a cover, which is secured pivotally to a peripheral wall of said game board; and said game board Including a plurality of peripheral walls defining a surface there-between for tossing at least one die thereon; and said game board further including a plurality of peripheral walls surrounding at least one storage compartment which; may be repositioned along a peripheral wall of said game board; and said game board further including a plurality of peripheral walls surrounding at least one consecutive series of blocks and with each of said blocks being individually selectively pivotally positioned between a displayed position and a concealed position for concealing or displaying integers which; may be repositioned along a peripheral wall of said game board; and said game board further including a plurality of peripheral walls surrounding at least one consecutive series of integers with each of said integers being individually selectively positioned between a displayed position and a concealed position which; may be repositioned along a peripheral wall of said game board; and said game board further including a plurality of peripheral walls surrounding at least one consecutive series of integers for identifying category of subject matter; and at least one set of valued question/answer cards of subject matter; and at least one die for generating a random integer for selectively concealing or displaying integers of said game board.

40. A dice game according to claim 39, wherein said series of the at least one consecutive series of integers to comprise the numbers one through four.

41. A dice game according to claim 39, wherein said series of the at least one consecutive series of integers for identifying category's of subject matter to comprise the numbers one through four.

42. A dice game according to claim 39, wherein said at least one die comprises a tetrahedron die having four sides, with each said side including a different integer from one through four.

43. A dice game according to claim 39, wherein said series of the at least one consecutive series of integers to comprise the numbers one through six.

44. A dice game according to claim 39, wherein said series of the at least one consecutive series of integers to comprise the numbers one through eight.

45. A dice game according to claim 39, wherein said series of the at least one consecutive series of integers to comprise the numbers one through nine.

46. A dice game according to claim 39, wherein said series of the at least one consecutive series of integers to comprise the numbers one through twelve.

47. A dice game according to claim 39, wherein said series of the at least one consecutive series of integers to comprise the numbers one through twenty.

48. A dice game according to claim 39, wherein said series of the at least one consecutive series of integers to comprise the numbers one through forty.

49. A dice game according to claim 39, wherein said series of the at least one consecutive series of integers for identifying category's of subject matter to comprise the numbers one through six.

50. A dice game according to claim 39, wherein said series of the at least one consecutive series of integers for identifying category's of subject matter to comprise the numbers one through eight.

51. A dice game according to claim 39, wherein said series of the at least one consecutive series of integers for identifying category's of subject matter to comprise the numbers one through nine.

52. A dice game according to claim 39, wherein said series of the at least one consecutive series of integers for identifying category's of subject matter to comprise the numbers one through twelve.

53. A dice game according to claim 39, wherein said series of the at least one consecutive series of integers for identifying category's of subject matter to comprise the numbers one through twenty.

54. A dice game according to claim 39, said series of the at least one consecutive series of integers for identifying category's of subject matter to comprise the numbers one through forty.

55. A dice game according to claim 39, wherein said at least one die comprises a cubical die having six sides, with each said side including a different integer from one through six.

56. A dice game according to claim 39, wherein said at least one die comprises a octahedron die having eight sides, with each said side including a different integer from one through eight.

57. A dice game according to claim 39, wherein said at least one die comprises a dodecahedron die having twelve sides, with each said side including a different integer from one through twelve.

58. A dice game according to claim 39, wherein said at least one die comprises a dodecahedron die having twenty sides, with each said side including a different integer from one through twenty.

* * * * *

UNITED STATES PATENT AND TRADEMARK OFFICE

CERTIFICATE OF CORRECTION

PATENT NO. : 6,752,393 B2 
DATED : December 22, 2004
INVENTOR(S) : Severino DiGirolamo, Cody James Shaw and Jolen Gerhard DiGirolamo It is certified that error appears in the above-identified patent and that said Letters Patent is hereby corrected as shown below:

Column 8,
Line 16, "FIG.1" should read -- FIG.1b --

Column 13,
Line 5, "Far" should read -- for --
Lines 23, 61 and 65, "selling" should read -- setting --
Line 55, insert the following missing text after "integers" -- for indentifying catagory's of subject matter --

Column 14,
Line 52, delete "Including" should read -- including --

Column 16,
Line 20, insert the following missing text after "claim 39," -- wherein --

Signed and Sealed this

Twenty-second Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,752,393 B2 
DATED : April 11, 2005
INVENTOR(S) : Severino DiGirolamo, Cody James Shaw and Jolen Gerhard DiGirolamo It is certified that error appears in the above-identified patent and that said Letters Patent is hereby corrected as shown below:

Column 14,
Line 49, "genie" should read -- game --

Column 16,
Line 38, "dodecahedron" should read -- icosahedrons --

Signed and Sealed this

Twenty-sixth Day of July, 2005

JON W. DUDAS
*Director of the United States Patent and Trademark Office*